US008593363B2

(12) United States Patent
McLean et al.

(10) Patent No.: US 8,593,363 B2
(45) Date of Patent: Nov. 26, 2013

(54) END-FED SLEEVE DIPOLE ANTENNA COMPRISING A ¾-WAVE TRANSFORMER

(75) Inventors: James McLean, Austin, TX (US); Kunio Yata, Tokyo (JP); Robert Sutton, Austin, TX (US); Hidetsugu Sakou, Tokyo (JP); Nobutaka Misawa, Tokyo (JP)

(73) Assignee: TDK Corporation, Chiba (JP)

( * ) Notice: Subject to any disclaimer, the term of this patent is extended or adjusted under 35 U.S.C. 154(b) by 440 days.

(21) Appl. No.: 13/015,280

(22) Filed: Jan. 27, 2011

(65) Prior Publication Data

US 2012/0194401 A1 Aug. 2, 2012

(51) Int. Cl.
*H01Q 9/16* (2006.01)

(52) U.S. Cl.
USPC ..... 343/792; 343/822

(58) Field of Classification Search
USPC ..... 343/791, 790, 792, 820, 821, 822
See application file for complete search history.

(56) References Cited

U.S. PATENT DOCUMENTS

| | | | | |
|---|---|---|---|---|
| 2,821,709 | A | 1/1958 | Fucci | |
| 3,139,620 | A | 6/1964 | Leidy et al. | |
| 3,750,181 | A | 7/1973 | Kuecken | |
| 4,097,870 | A | 6/1978 | Fulmer, Sr. et al. | |
| 4,282,528 | A | 8/1981 | Aspinwall | |
| 4,290,071 | A * | 9/1981 | Fenwick | 343/819 |
| 4,352,109 | A | 9/1982 | Reynolds et al. | |
| 4,410,893 | A | 10/1983 | Griffee | |
| 4,509,056 | A | 4/1985 | Ploussios | |
| 4,730,195 | A | 3/1988 | Phillips et al. | |
| 4,940,989 | A | 7/1990 | Austin | |
| 4,963,879 | A | 10/1990 | Lin | |
| 5,079,562 | A | 1/1992 | Yarsunas et al. | |
| 5,248,988 | A | 9/1993 | Makino | |
| 5,440,317 | A | 8/1995 | Jalloul et al. | |
| 5,719,587 | A | 2/1998 | Rodal | |
| 5,812,097 | A | 9/1998 | Maldonado | |
| 5,963,180 | A | 10/1999 | Leisten | |
| 5,999,140 | A | 12/1999 | Johnson | |
| 6,037,907 | A | 3/2000 | Ha et al. | |
| 6,054,962 | A | 4/2000 | Ha et al. | |
| 6,057,804 | A | 5/2000 | Kaegegein | |
| 6,337,666 | B1 | 1/2002 | Bishop | |
| 6,421,024 | B1 | 7/2002 | Stolle | |
| 6,552,692 | B1 | 4/2003 | Zeilinger et al. | |
| 6,657,601 | B2 | 12/2003 | McLean | |
| 6,828,944 | B2 | 12/2004 | Martiskainen et al. | |
| 7,164,389 | B1 | 1/2007 | Platt | |
| 7,248,227 | B2 | 7/2007 | Chen | |
| 2003/0030591 | A1 * | 2/2003 | Gipson et al. | 343/792 |
| 2006/0139228 | A1 * | 6/2006 | Lin et al. | 343/792 |
| 2007/0052609 | A1 * | 3/2007 | Lee | 343/792 |
| 2007/0139289 | A1 * | 6/2007 | Lee et al. | 343/792 |

* cited by examiner

*Primary Examiner* — Hoanganh Le
(74) *Attorney, Agent, or Firm* — Kevin L. Daffer; Daffer McDaniel LLP

(57) ABSTRACT

An end-fed sleeve dipole is provided herein with improved impedance match and increased bandwidth by incorporating a ¾-wavelength transformer in the antenna design. The ¾-wavelength transformer is compatible with a number of different choking schemes, including but not limited to, a single ¼-wave choke sleeve, a single ¼-wave choke sleeve with additional ferrite beads, and two or more ¼-wave choke sleeves with or without ferrite beads. In some embodiments, one or more shunt resonators may be used to provide additional impedance compensation.

20 Claims, 8 Drawing Sheets

300

310

END-FED SLEEVE DIPOLE ANTENNA COMPRISING A ¾-WAVE TRANSFORMER

BACKGROUND OF THE INVENTION

1. Field of the Invention

This invention relates to linear dipole antennas and, more particularly, to an end-fed sleeve dipole antenna with improved impedance match, increased bandwidth and simplified mechanical design.

2. Description of the Related Art

The following descriptions and examples are given as background only.

Linear dipole antennas are often formed by coupling two ¼-wavelength conductors, or radiative elements, back to back for a total length of $\lambda_{fs}/2$, where $\lambda_{fs}$ is the free space wavelength of the antenna radiation. Dipoles whose total length is one-half the wavelength of the radiated signal are called ½-wave dipoles, and in many cases, the term "dipole" is synonymous with "½-wave dipole." The radiation resistance of an ideal ½-wave dipole is approximately 73 Ohms (if wire diameter is ignored), and the maximum theoretical directivity of the ideal ½-wave dipole is 1.64, or 2.15 dBi. However, the actual gain may be a little less due to ohmic losses.

There are generally two types of linear dipole antennas: center-fed and end-fed dipoles. In center-fed dipole 100 of FIG. 1, the radiative elements 110/120 are arranged back-to-back and are fed at the center-point or "feed point" 130 of the dipole by a feed transmission line 140 extending away from the dipole in a direction perpendicular to the dipole axis (i.e., the longitudinal axis of the dipole extending through the radiative elements). Balun 150 is coupled to the feed point to effect a transformation from the balanced (symmetric) feed point to the unbalanced (e.g. coaxial) transmission line, and in some cases, to match the feed point impedance to the characteristic impedance of the coaxial feed transmission line.

Similar to the center-fed dipole, end-fed dipole 200 of FIG. 2 generally comprises a pair of radiating elements 210/220, which are driven at center feed point 230 via internal feed transmission line 240. However, the end-fed dipole differs from the center-fed dipole in that it is driven from one end by routing the (internal) feed transmission line along the dipole axis. This prevents the feed transmission line from interfering with the antenna radiation pattern in the H-plane, thus enabling the end-fed dipole to produce a nearly perfect isotropic radiation pattern in the H-plane. However, it is generally necessary to employ some sort of "choke" 250 at lower radiating element 220 of the end-fed dipole to prevent the antenna current from inducing common mode currents on the exterior of the feed transmission line and distorting the E-plane pattern. Pattern distortions caused by common mode currents are discussed in more detail below with reference to FIGS. 3A-C.

By definition, the E-plane of an antenna is the plane containing the far-field electric field and the direction of maximum radiation. Thus, for an electric dipole and a linear dipole, the E-plane contains the axis of the antenna. Since the ideal linear dipole is rotationally symmetric about its axis, the E-plane definition really describes one of an infinite number of planes containing the dipole axis. By corollary, the H-plane is the plane perpendicular to the dipole axis.

FIG. 3A shows 3-dimensional radiation pattern 300 of an ideal ½-wave linear dipole at its ½-wave (fundamental) resonance. As shown in FIG. 3A, an ideal antenna will exhibit a near perfect isotropic radiation pattern in the H-plane and a directional pattern in the E-plane. An isotropic H-plane pattern is desirable in many metrology applications, including Over-The-Air (OTA) testing of mobile telephones and other devices.

However, any "real" dipole, which is fed by a single-ended transmission line (such as a coaxial cable) or even a balanced transmission line, will suffer at least some performance deviation or degradation from the idealized pattern (shown in FIG. 3A), due to common mode currents flowing from the antenna onto the exterior of the feed transmission line or electromagnetic coupling of the near or far fields directly to the line. For instance, while the end-fed dipole exhibits very good isotropy in the H-plane, it demonstrates significant E-plane pattern distortion when the dipole is fabricated without a choke (e.g., choke 250 of FIG. 2). That is, without a choke in place to demarcate the lower radiating element, the end-fed dipole will induce (via conduction) common mode current on the exterior of the feed transmission line. This common mode current results in a current distribution, which is much longer than the intended ½-wavelength of the dipole, and thus, greatly perturbs the E-plane radiation pattern. If the feed transmission line is coincident with the axis of the end-fed dipole, the H-plane radiation pattern will remain isotropic no matter how much common mode coupling exists. However, poor test results may be obtained if the distortion in the E-plane pattern is great enough.

3-dimensional radiation pattern 310 of a half-wave linear dipole operating at its ⅗-wave resonance is shown in FIG. 3B to demonstrate the pattern distortion that may be caused when common mode currents are induced on the exterior of the feed line. In other words, FIG. 3B illustrates the case in which the coupling of common mode currents results in a current distribution on the feed line, which is much longer than the intended ½-wavelength. This current distribution clearly perturbs the antenna radiation pattern, as shown in the comparison of FIGS. 3A and 3B.

FIG. 3C shows 2-dimensional graph 330 comparing the E-plane patterns of a ½-wave linear dipole operating at its ½-wave (fundamental) resonance 340 and its ⅗-wave resonance 350. The E-plane pattern distortion generated by operating the dipole at its ⅗-wave resonance (FIG. 3B) is clearly illustrated in FIG. 3C. In addition to E-plane pattern distortion, FIG. 3C indicates how common mode currents can lead to a near nulling of the far fields in the H-plane. While E-plane pattern distortion is not necessarily a problem in OTA testing, the deep null produced in the H-plane (−3.3 dBi gain, FIG. 3C) results in very poor quality OTA test measurements and should be avoided.

In order to avoid pattern distortion caused by common mode currents, it is often desirable to employ some sort of "choke" 250 on end-fed dipole 200 (FIG. 2) to demarcate lower radiating element 220 and to "choke off" or prevent the antenna current from flowing along the exterior of the feed transmission line. At sufficiently low frequencies (e.g., frequencies up to about 100 MHz), ferrite choke beads may be coupled to the feed transmission line of an end-fed dipole to choke off the common mode current induced by the dipole. However, ferrite choke beads are not typically used at significantly higher frequencies, such as ultra high frequencies (UHF) and above, since they are typically very lossy at these frequencies and greatly reduce the radiation efficiency of the antenna. In addition, as ferrite choke beads cannot provide a high choking impedance at such high frequencies, they fail to prevent common mode current from flowing on the exterior of the feed transmission line.

Another common approach for reducing pattern distortion is to employ a ¼-wave choke sleeve. The most abstract description of a "sleeve," in the context of linear antennas, is that the skin effect will prevent penetration of electromagnetic fields into a good conductor. Thus, a conducting sleeve can support two independent current distributions: one on its interior surface and one on its exterior surface. While somewhat limited in bandwidth, the ¼-wave choke sleeve is intrinsically low loss and can provide an extremely high choking impedance near its ¼-wave resonance frequency.

Conventional end-fed dipole 400 employing a ¼-wave choke sleeve is shown in the cross-sectional diagram of FIG. 4A. In the conventional end-fed sleeve dipole, feed transmission line 450 is routed through one half of dipole 410 and coupled to the other half of dipole 420 at feed region 440 of the antenna. The feed transmission line typically comprises a semi-rigid (or rigid) coaxial cable having 50 Ohms characteristic impedance. Dielectric support 430 is provided at feed region 440 to physically separate and electrically isolate the two radiative elements of the dipole. Dielectric spacer 435 is provided at the lower end of the dipole to ensure that feed transmission line 450 is arranged concentrically within the left half of the dipole.

At feed region 440, the outer conductor (or shield) of coaxial feed transmission line 450 is electrically connected to the left half of the dipole (e.g., by soldering the outer conductor to the left dipole element). This connection also establishes a short circuit inside the choke near feed region 440, while dielectric spacer 435 maintains concentricity, thus, preventing an inadvertent short at the lower end of the dipole. The center conductor of coaxial feed transmission line 450 passes through dielectric support 430 and is connected to the right half of the dipole (again, by soldering the center conductor to the end of the right dipole element). The free end of the coaxial feed transmission line is coupled to coaxial input connector 460 for connection to a source.

In FIG. 4A, the exterior surface of the left half of dipole 410 serves as the radiating element, while the interior surface serves as the outer conductor of the choke sleeve. The exterior surface of the portion of coaxial feed transmission line 450 extending through the left half of the dipole serves as the inner conductor of the choke sleeve. It is generally desirable to make the diameter of the dipole element large compared to the external diameter of the coaxial feed line. This increases the characteristic impedance of the choke sleeve, and thus, the effectiveness of the choke.

In a half-wave dipole, the left half of the dipole (comprising the first radiating element and the choke sleeve) and the right half of the dipole (comprising the dielectric support and the second radiating element) are each formed to be approximately $\lambda_{fs}/4$ in length, where $\lambda_{fs}$ is the free-space wavelength of the dipole radiation. A choke sleeve, which is $\lambda_{fs}/4$ in length, is referred to as a "¼-wave choke sleeve."

A ¼-wave choke sleeve exploits the impedance transformation of a uniform transmission line to transform a short circuit (at the feed region 440) to an open circuit, which is placed between the lower end of the dipole and the exterior of the feed transmission line (e.g., at dielectric spacer 435). This transformation allows the ¼-wave choke sleeve to effectively choke the current at the bottom of the choke sleeve at the ¼-wave (resonant) frequency. However, near field coupling of the electric field to the exterior of the feed transmission line still exists, even if the current is reduced to zero at the bottom of the choke sleeve. In addition, the choke acts as an inductance connecting the lower end of the dipole to the exterior of the coaxial feed transmission line below its ¼-wave frequency. Because of these two coupling mechanisms, the ¼-wave choke sleeve is not entirely effective, as it cannot completely eliminate common mode currents on the exterior of the coaxial feed transmission line.

In some cases, performance may be improved by utilizing two or more ¼-wave choke sleeves followed by one or more ferrite choke beads. For example, and as shown in end-fed dipole 400' of FIG. 4B, two ¼-wave choke sleeves 410/470 may be used to increase choking impedance, while ferrite beads 480 are coupled behind the chokes to reduce coupling of the near electric field to the exterior of coaxial feed transmission line 450. While this may slightly improve performance over the embodiment shown in FIG. 4A, the overall performance of the dipole antenna shown in FIG. 4B is still limited by poor impedance match and narrow bandwidth.

Therefore, a need exists for an improved end-fed sleeve dipole, and more specifically, an end-fed sleeve dipole with improved impedance match and increased bandwidth that exhibits an E-plane pattern that is similar to the pattern of an ideal half-wave dipole. In addition to performance, it is also desirable to provide a dipole antenna that maintains a simple mechanical design, as a difficult mechanical design generally results in a manufactured product with reduced reliability and great variation from unit to unit.

SUMMARY OF THE INVENTION

The following description of various embodiments of a dipole antenna is not to be construed in any way as limiting the subject matter of the appended claims.

A dipole antenna is provided herein with improved impedance match and increased bandwidth, while maintaining a simple mechanical design. According to one embodiment, the dipole antenna comprises a first hollow conductive tube forming a first dipole element of the dipole antenna, and a second hollow conductive tube forming a second dipole element of the dipole antenna. The first and second hollow conductive tubes are coupled end-to-end along a longitudinal axis of the dipole antenna and are separated by a dielectric support. A transmission feed line is routed through the second hollow conductive tube along the longitudinal axis and coupled to one end of the first hollow conductive tube at a feed region of the dipole antenna. An input connector is also provided for coupling the transmission feed line to a source. An antenna of this sort is typically referred to as an "end-fed dipole antenna."

According to one embodiment, the end-fed dipole antenna may comprise a single choke sleeve (i.e., a "first choke sleeve"). In this embodiment, an inner surface of the second hollow conductive tube and an outer surface of a first portion of the transmission feed line, which is routed through the second hollow conductive tube, forms the first choke sleeve of the end-fed sleeve dipole antenna. In some cases, the physical length of the first choke sleeve may be approximately ¼ of a free-space wavelength long, resulting in a "¼-wave choke sleeve." In some cases, one or more choke beads may be coupled to the transmission feed line behind the first choke sleeve (i.e., between the input connector and the second hollow conductive tube) to improve performance by reducing coupling of the near electric field to the exterior of the transmission feed line.

According to another embodiment, the end-fed dipole antenna may comprise two or more choke sleeves. In this embodiment, a "first choke sleeve" is formed within the second hollow conductive tube, as described above. To form a "second choke sleeve," a third hollow conductive tube is arranged between the input connector and the second hollow conductive tube, and the transmission feed line is routed through the third hollow conductive tube along the longitudinal axis of the sleeve dipole antenna. The inner surface of the third hollow conductive tube and an outer surface of a second portion of the transmission feed line, which is routed through the third hollow conductive tube, forms the "second choke sleeve" of the end-fed sleeve dipole antenna. Like the first choke sleeve, the physical length of the second choke sleeve may be approximately ¼ of a free-space wavelength long (i.e., a "¼-wave choke sleeve"). In some cases, one or more choke beads may be coupled to the transmission feed line behind the second choke sleeve (i.e., between the input connector and the third hollow conductive tube) to improve performance.

Unlike conventional end-fed sleeve dipole antennas, the antenna described herein is preferably implemented with a ¾-wavelength transformer by "operably configuring" the transmission feed line to behave as a ¾-wavelength transformer. To be "operably configured" as a ¾-wave transformer, the transmission feed line must have a length (measured between the input connector and the feed region), which is approximately ¾ wavelengths long at a center frequency of a wave propagating through the transmission feed line, and must exhibit a characteristic impedance ($Z_{0t}$), which is approximately the geometric mean of the two characteristic impedances between which it transforms.

In some embodiments, greater bandwidth may be obtained by selecting a transmission feed line having a characteristic impedance substantially greater than 50 Ohms. For example, the characteristic impedance of the transmission feed line may range between about 70-100 Ohms in some embodiments. In one preferred embodiment, a transmission feed line having approximately 75 Ohms characteristic impedance may be used to implement the ¾-wave transformer.

The ¾-wavelength transformer disclosed herein is compatible with a number of different choking schemes, including but not limited to, a single ¼-wave choke sleeve, a single ¼-wave choke sleeve with additional ferrite beads, and two or more ¼-wave choke sleeves with or without ferrite beads. Although two choking schemes are described above, it is noted that a ¾-wavelength transformer may be utilized in conjunction with other choking schemes not specifically mentioned herein without departing from the scope of the invention.

In some embodiments, one or more shunt resonators may be coupled to the end-fed sleeve dipole antenna to provide additional impedance compensation. The one or more shunt resonators are compatible with any of the embodiments disclosed herein.

According to one embodiment, one or more shunt resonators may be formed of lumped inductive (L) and capacitive (C) elements, which are coupled in shunt across the feed region of the end-fed sleeve dipole antenna. If more than one shunt resonator is used, it is desirable to symmetrically space the plurality of shunt resonators around the feed region at regular angular intervals, as any asymmetry in the antenna design may lead to an anisotropic H-plane pattern.

According to another embodiment, a coaxial shunt resonator may be formed from a length of coaxial cable, which extends along the longitudinal axis of the end-fed sleeve dipole antenna between opposite ends of the first hollow conductive tube. The coaxial shunt resonator may be formed from a coaxial cable having a length approximately equal to ¼ of a wavelength of the center frequency propagating through the coaxial cable and a characteristic impedance which is compatible with the ¾-wave transformer. In some embodiments, the characteristic impedance of the coaxial shunt resonator may range between about 90-95 Ohms.

If a coaxial shunt resonator is used, a "transposition" may be needed at the feed region of the dipole for electrically connecting the transmission feed line to the coaxial shunt resonator. In one embodiment, the transposition may comprise two distinct, but symmetrically configured "transposition components." In such an embodiment, a first transposition component may couple an inner conductor of the transmission feed line to an outer conductor of the coaxial shunt resonator, while a second transposition component couples an inner conductor of the coaxial shunt resonator to an outer conductor of the transmission feed line. In addition to providing an electrical connection, the transposition improves mechanical stability at the feed region.

BRIEF DESCRIPTION OF THE DRAWINGS

Other objects and advantages of the invention will become apparent upon reading the following detailed description and upon reference to the accompanying drawings in which.

Figure 1:
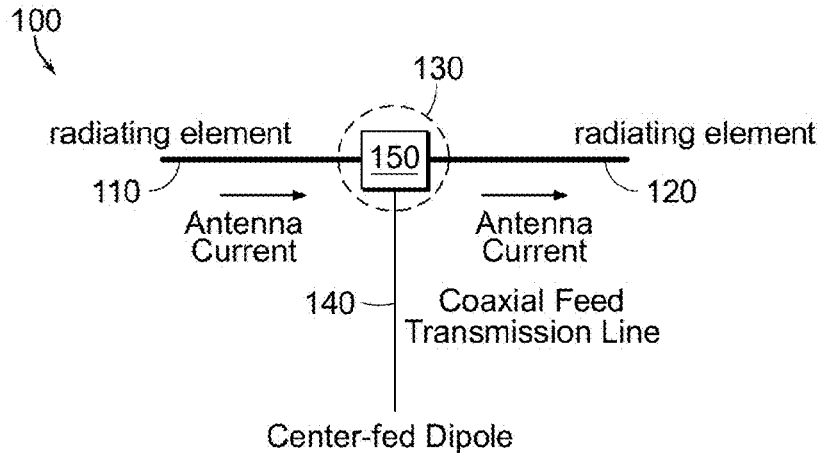
FIG. 1 (Prior Art)
FIG. 1 is a schematic diagram of a center-fed dipole.
Figure 2:
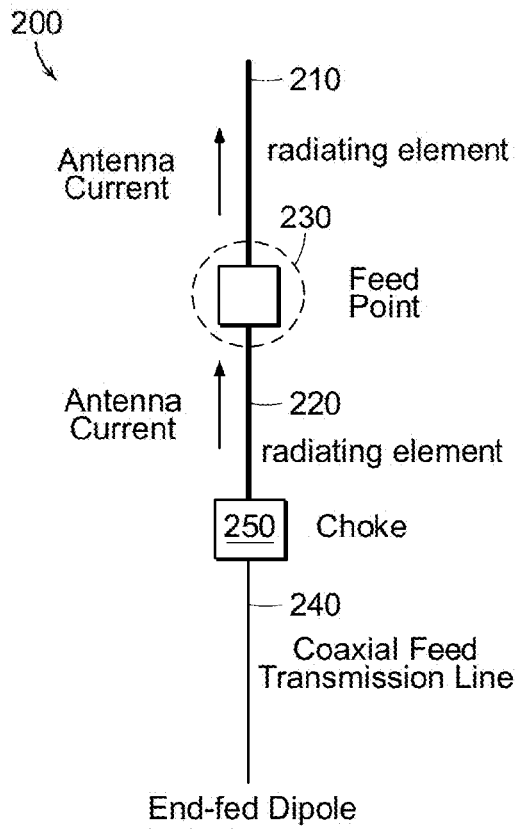
FIG. 2 (Prior Art)
FIG. 2 is a schematic diagram of an end-fed dipole.
Figure 3A:
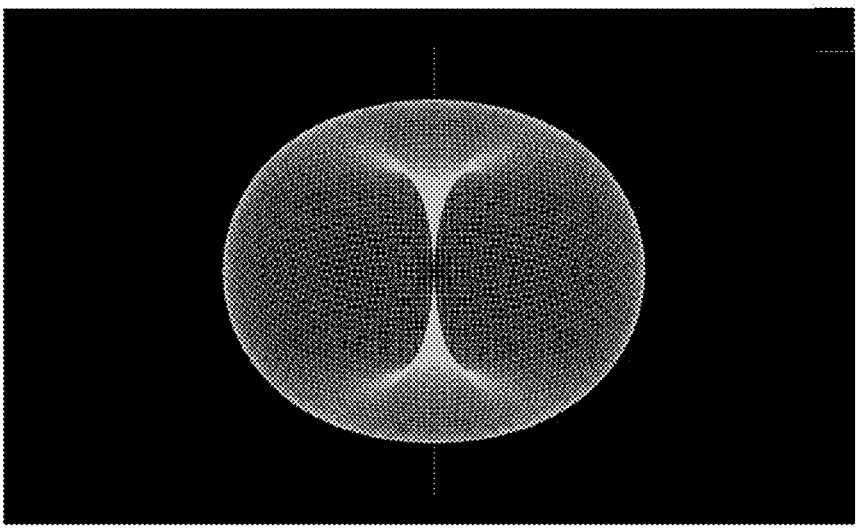
FIG. 3A (Prior Art)
FIG. 3A is a 3-dimensional graph of a radiation pattern generated by a linear dipole operating at its ½-wave (fundamental) resonance.
Figure 3B:
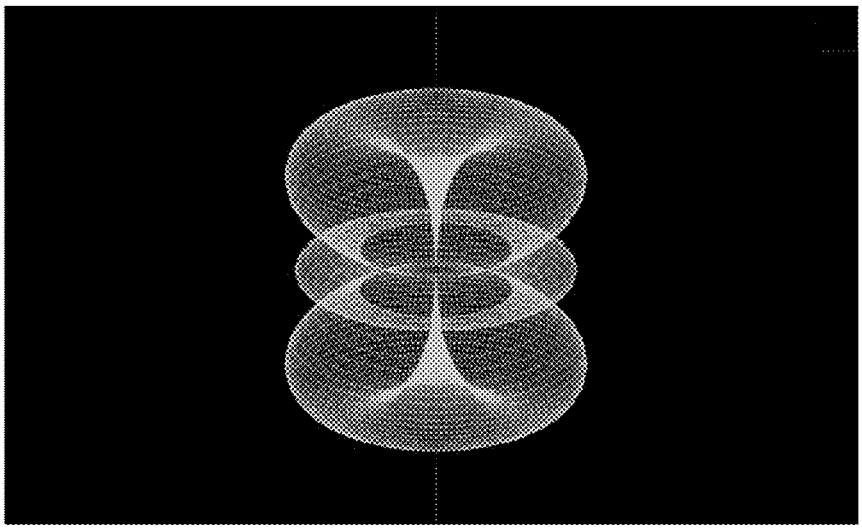
FIG. 3B (Prior Art)
FIG. 3B is a 3-dimensional graph of a radiation pattern generated by a linear dipole operating at its ⅗-wave resonance, demonstrating the pattern distortion caused when common mode currents are induced on the transmission feed line.
Figure 3C:
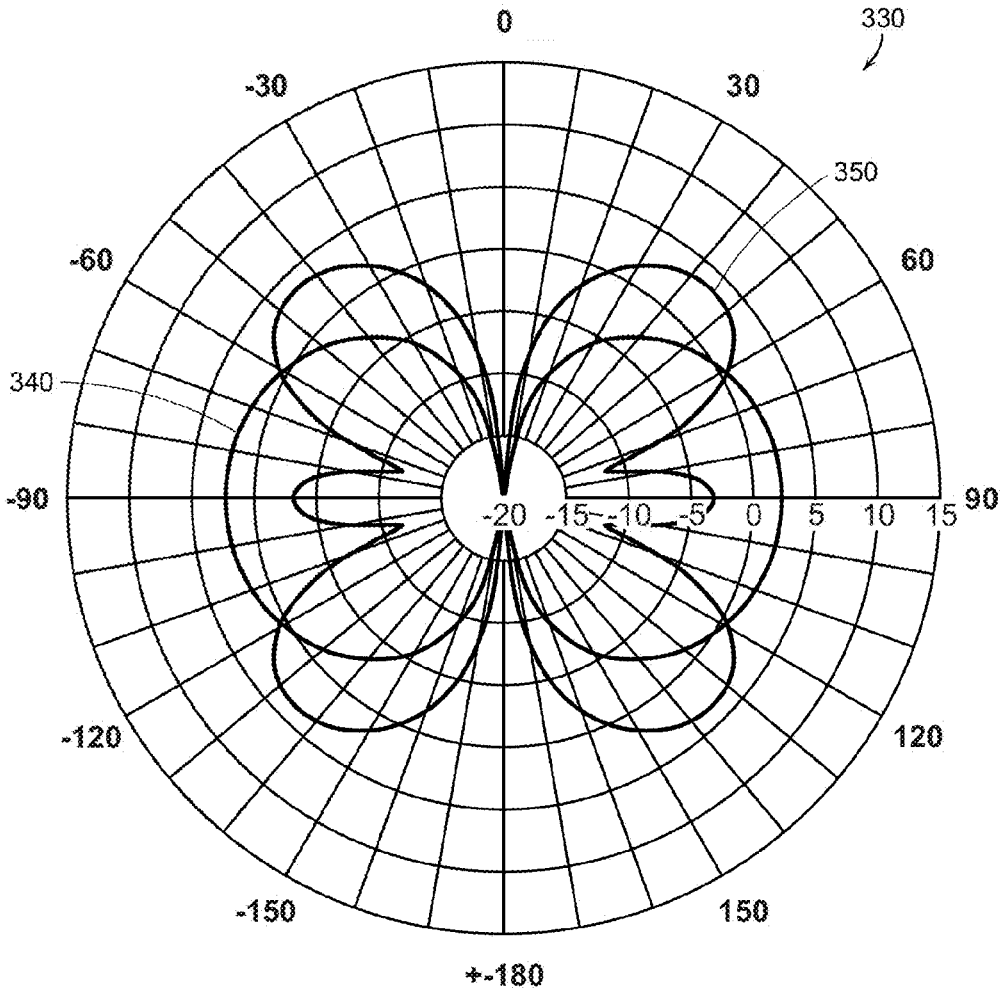
FIG. 3C (Prior Art)
FIG. 3C is a 2-dimensional graph comparing the E-plane radiation patterns generated by a linear dipole operating at its ½-wave (fundamental) resonance and at its ⅗-wave resonance.

While the invention is susceptible to various modifications and alternative forms, specific embodiments thereof are shown by way of example in the drawings and will herein be described in detail. It should be understood, however, that the drawings and detailed description thereto are not intended to limit the invention to the particular form disclosed, but on the contrary, the intention is to cover all modifications, equivalents and alternatives falling within the spirit and scope of the present invention as defined by the appended claims.

DETAILED DESCRIPTION OF PREFERRED EMBODIMENTS

Conventional end-fed dipoles employing ¼-wave choke sleeves and ferrite-based choke beads suffer from poor impedance match and narrow bandwidth, and thus, fail to provide good pattern performance over a wide operating frequency range. To overcome the disadvantages of conventional dipoles, an impedance transformer is used herein to provide both transformation and compensation for an improved end-fed sleeve dipole. In some embodiments, a shunt resonator may be used in combination with the impedance transformer to provide additional impedance compensation. In preferred embodiments, the impedance transformer improves pattern performance while maintaining a simple mechanical design. This simplifies the fabrication of the end-fed dipole, reduces fabrication costs and ensures compatibility with a number of different choking schemes, including a single ¼-wave choke, a single ¼-wave choke sleeve with additional ferrite beads, and two or more ¼-wave choke sleeves with or without ferrite beads.

The most commonly used RF and microwave system impedance is 50 Ohms. When wire diameter is ignored, an ideal half-wave linear dipole exhibits approximately 73 Ohms resistive driving point impedance at its fundamental series resonance. In reality, however, a linear dipole with finite diameter exhibits a slightly higher resistance (typically closer to 80 Ohms) at its fundamental series resistance. Because this resistance is a series resonance, the magnitude of the driving point impedance is minimum at this point and greater than the resonant value (i.e., greater than 80 Ohms) at all other frequencies. Thus, greater bandwidth can be obtained by increasing the overall system impedance to a larger value, say 100 Ohms. However, because a 100 Ohm source is not very practical, greater bandwidth is obtained herein by transforming a typical 50 Ohm source impedance to a value closer to 100 Ohms.

Figure 4A:
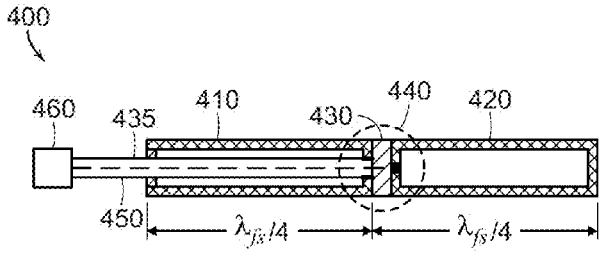
FIG. 4A (Prior Art)
FIG. 4A is a cross-sectional diagram illustrating a conventional end-fed sleeve dipole comprising a single, ¼-wave choke sleeve.
Figure 5:
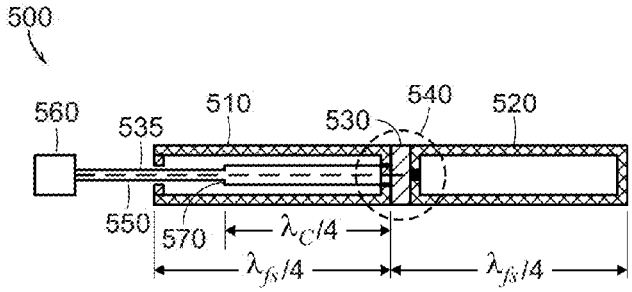
FIG. 5 is a cross-sectional diagram illustrating one embodiment of an end-fed sleeve dipole comprising a single, ¼-wave choke sleeve and a ¼-wave transformer.

A. An Embodiment of an End-Fed Dipole Including a ¼-Wave Choke Sleeve and a ¼-Wave Transformer:

FIG. 5 illustrates a cross-sectional view of end-fed dipole 500 employing a ¼-wave choke sleeve, similar to the dipole shown in FIG. 4A. Because many of the components shown in FIG. 5 were described above in FIG. 4A, components with like numerals (e.g., 410-460 of FIGS. 4A and 510-560 of FIG. 5) will not be described further herein for purposes of brevity. In general, the embodiment shown in FIG. 5 differs from that shown in FIG. 4A by adding ¼-wave transformer 570 to improve the performance of end-fed sleeve dipole 500.

¼-wave transformer 570 shown in FIG. 5 is implemented with coaxial transmission line 550 approximately $\lambda_c/4$ in length, where $\lambda_c$ is the wavelength in the coaxial transmission line. In FIG. 5, the ¼-wave transformer is formed within 50 Ohm coaxial feed transmission line 550 by stepping the diameter of the outer conductor of coaxial feed transmission line 550. However, a transformer of this sort may also be achieved by stepping the diameter of the inner conductor, or by stepping the diameters of the inner and outer conductors. Altering the diameter(s) of the conductor(s) alters the characteristic impedance of the line by effectively inserting a length of transmission line having a different (higher or lower) characteristic impedance.

For instance, the characteristic impedance ($Z_0$) of a coaxial transmission line is determined by the natural logarithm of the ratio of the outer radii ($r_o$) to the inner radii ($r_i$) (or diameter):

$$Z_0 = \sqrt{\frac{\mu_R}{\varepsilon_R}}\, 60\log\left(\frac{r_o}{r_i}\right),$$

where $\mu_R$ is the relative permeability and $\in_R$ is the relative permittivity of the coaxial line. Thus, stepping or changing the diameter of the line effectively inserts a length of transmission line having a different (higher or lower) characteristic impedance (e.g., $Z_{02}$) than the characteristic impedance (e.g., $Z_{01}$) of a line with constant diameter. A transformer having a stepped diameter will exhibit an overall characteristic impedance $Z_{0t}$, which is approximately the geometric mean of the two characteristic impedances $Z_{01}$ and $Z_{02}$ between which it transforms:

$$Z_{0t}=\sqrt{Z_{01}Z_{02}}$$

While it is possible to fabricate a device as shown in FIG. 5, it is somewhat expensive and difficult to do so. Since typical coaxial cable employs a PTFE dielectric with a relative permittivity ($\in_R$) of 2.1, the wavelength in the cable ($\lambda_c$) is shorter than the wavelength in air ($\lambda_{fs}$) by a factor of $1/\sqrt{(\in_R)}$. This results in a ¼-wave transformer (570), which is roughly 30% shorter than the ¼-wave choke sleeve (510), making the device shown in FIG. 5 rather difficult to fabricate. It should also be kept in mind that metallic junctions, such as solder joints, reduce the efficiency of the system. Thus, it is strongly desirable to produce the antenna from as few of parts as possible.

B. Embodiments of an End-Fed Dipole Including One or More ¼-Wave Choke Sleeves and a ¾-Wave Transformer:

In general, any length of transmission line that is an odd-integer number of a ¼-wavelength (e.g. ¼, ¾, ⅝, etc) will behave similar to a ¼-wave transformer in terms of its impedance transforming capability. The difference between the different lengths of line is the frequency sensitivity of their characteristics. For instance, longer lines store more energy, which results in narrower bandwidth. Through extensive testing and numerical simulation, the present inventors have determined that while a ¾-wavelength section of transmission line will necessarily suffer some performance degradation (i.e., narrower bandwidth) as compared to a ¼-wavelength section of transmission line, the performance of a ¾-wave transformer is adequate for the purposes of the end-fed dipole.

Using a ¾-wavelength transformer in lieu of a ¼-wavelength transformer is preferred by the present inventors, since this enables the entire coaxial feed transmission line internal to the antenna to be realized with a single section of coaxial cable having constant diameter, and thus, constant characteristic impedance. That is, no step in impedance is required to produce a ¾-wavelength transformer, and thus, no change in dimensions is required. Use of a ¾-wavelength transformer enables a modified sleeve dipole to be fabricated with improved bandwidth and impedance match, while maintaining a simple mechanical design. In addition to improved manufacturability, the use of a ¾-wavelength transformer in lieu of a ¼-wave transformer reduces fabrication costs and improves system efficiency.

Figure 6A:
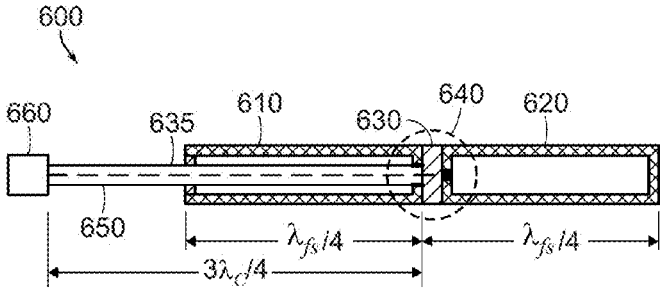
FIG. 6A is a cross-sectional diagram illustrating one preferred embodiment of an end-fed sleeve dipole comprising a single, ¼-wave choke sleeve and a ¾-wave transformer.
Figure 6B:
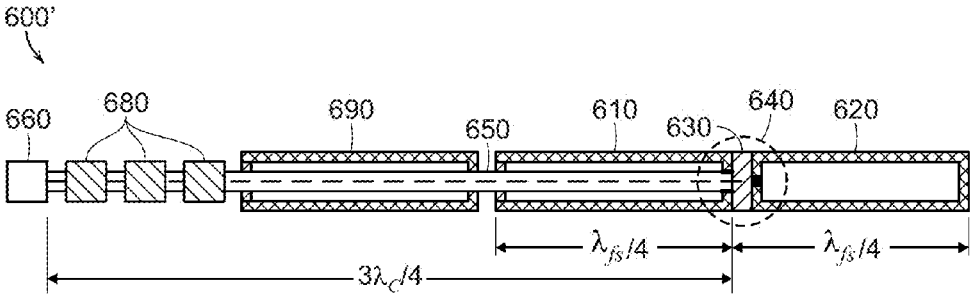
FIG. 6B is a cross-sectional diagram illustrating another preferred embodiment of an end-fed sleeve dipole comprising two ¼-wave choke sleeves, a ¾-wave transformer and a plurality of ferrite choke beads.

The ¾-wavelength transformer disclosed herein is compatible with a number of different choking schemes, including but not limited to, a single ¼-wave choke sleeve (as shown, e.g., in FIG. 6A), a single ¼-wave choke sleeve with additional ferrite beads (as shown, e.g., in FIG. 11), and two or more ¼-wave choke sleeves with or without ferrite beads (as shown, e.g., in FIG. 6B). Although two choking schemes are described below, it is noted that a ¾-wavelength transformer may be utilized in conjunction with other choking schemes not specifically mentioned herein without departing from the scope of the invention.

FIG. 6A illustrates one preferred embodiment of improved end-fed sleeve dipole 600 comprising a single ¼-wave choke sleeve and a ¾-wavelength transformer. As in previous embodiments, the end-fed sleeve dipole shown in FIG. 6A comprises feed transmission line 650, which is routed through one half of dipole 610 along the dipole axis and coupled to the other half of dipole 620 at the center-point or feed region 640 of the antenna. Dipole elements 610/620 are formed from hollow conductive tubes, which in some embodiments, comprise brass or copper tubular elements. In FIG. 6A, upper dipole element 620 comprises a tubular element, which is capped at both ends. However, the ends of lower dipole element 610 remain open to allow routing and coupling of feed transmission line 650.

Dielectric support 630 physically separates and electrically isolates two radiating elements 610/620 of the dipole. In one embodiment, the dielectric support may comprise a polystyrene or Rexolite® material. Feed transmission line 650 is routed through the open ends of lower radiating element 610 along the dipole axis and coupled to the dipole elements at feed region 640. Specifically, the outer conductor (or shield) of coaxial feed transmission line 650 is electrically connected (i.e., shorted) to the left half of the dipole (e.g., by soldering the outer conductor to the hollow conductive tube of the left half of the dipole), while the center conductor of coaxial feed transmission line 650 is passed through dielectric support 630 and connected to the right half of the dipole (e.g., by soldering the center conductor to the capped end of the hollow conductive tube of the right half of the dipole). As in previous embodiments, dielectric spacer 635 is provided at the lower end of the dipole to maintain concentricity and to prevent an inadvertent short at the lower end of the dipole. The free end of the coaxial feed transmission line is coupled to coaxial input connector 660 for connection to a source.

In the embodiment of a ½-wave dipole, each half of the dipole is $\lambda_{fs}/4$ in length, where $\lambda_{fs}$ is the free-space wavelength of the dipole. As the choke sleeve is embodied within the left half of the dipole, it too will be ¼ of a free-space wavelength in length. As indicated above, the exterior surface of the left half of dipole 610 serves as the lower radiating element, while the interior surface serves as the outer conductor of the choke sleeve. The exterior surface of the portion of coaxial feed transmission line 650 extending through the left half of dipole 610 serves as the inner conductor of the choke sleeve.

As noted above, the ¼-wave choke sleeve exploits the impedance transformation of a uniform transmission line to transform the short circuit formed near feed region 640 of the dipole to an open circuit, which is placed between the lower end of the dipole and the exterior of the feed transmission line (e.g., at dielectric spacer 635). This transformation allows the ¼-wave choke sleeve to effectively choke the current at the bottom of the choke sleeve at the ¼-wave (resonant) frequency.

Figure 4B:
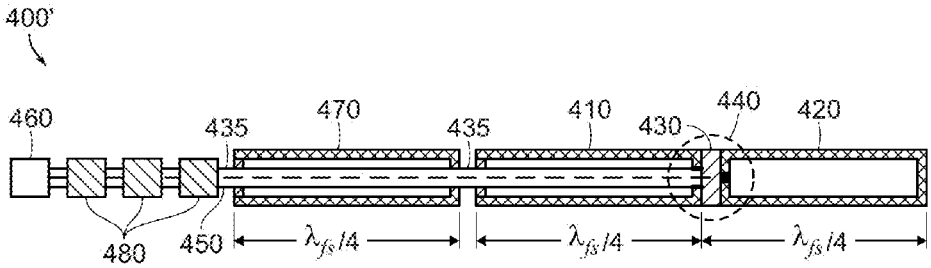
FIG. 4B (Prior Art)
FIG. 4B is a cross-sectional diagram illustrating another conventional end-fed sleeve dipole comprising two ¼-wave choke sleeves and a plurality of ferrite choke beads.

To implement a ¾-wave transformer, the 50 Ohm coaxial feed transmission line utilized in FIGS. 4 and 5 is replaced with a coaxial cable, whose characteristic impedance is substantially greater than 50 Ohms. In one embodiment, the characteristic impedance of coaxial feed transmission line 650 may range between about 70 Ohms and about 100 Ohms. The characteristic impedance chosen for a particular transformer generally depends on the desired operating frequency range of the dipole For instance, a ¾-wave transformer (intended to operate between a resistive source and load) requires a length of transmission line that is approximately ¾ of a wavelength long and exhibits a characteristic impedance $Z_{0t}$ which is approximately the geometric mean of two characteristic impedance between which it transforms:

$$Z_{0t}=\sqrt{Z_{01}Z_{02}}$$

However, the situation becomes more complicated when the ¾-wave transformer is implemented within a dipole, since the antenna is a frequency dependent complex load. Generally, the dipole operates near its fundamental half-wave resonance and thus exhibits an input impedance similar to a series resonant RLC network. If one employs a characteristic impedance in the transformer, which is precisely the geometric mean between the source (50 Ohms) and the (real) impedance of the antenna at resonance (approximately 73-75 Ohms), then a very good match with be achieved at the resonant frequency. However, if one employs a somewhat higher characteristic impedance in the transformer, which then effectively transforms the 50 Ohm source to an impedance level above the 73 Ohm real impedance at resonance, the match at the resonance frequency will degrade somewhat, but the match elsewhere will be improved. Thus, better broadband performance can be obtained by implementing the ¾-wave transformer with a section of transmission line having a characteristic impedance substantially greater than 50 Ohms.

In one embodiment, in which the end-fed sleeve dipole is configured for operating in the vicinity of 800-1000 MHz, the ¾-wave transformer may be implemented with a section of 75 Ohm coaxial line having a ¾-wave frequency of 800 MHz. A commercially available semi-rigid coaxial cable suitable for this application is: UT-141-75-TP/CE75141 available from the Micro-Coax Company of 206 Jones Blvd. Pottstown, Pa. 19464. This cable has a published propagation velocity of 70% of the free-space speed of light. Thus, a section of this cable, which is ¾-wavelength long at 800 MHz will have a physical length of 182.5 mm.

The physical length of the ¾-wave transformer is the length extending between coaxial connector 660 and feed point 640. This length is approximately ¾ of the wavelength ($\lambda_c$)propagating through the coaxial cable at the center frequency. As the coaxial cable contains a dielectric material (e.g., PTFE with a relativity of $\in_R$=2.1), the wavelength in the cable ($\mu_c$) will be shorter than that in air ($\lambda_{fs}$) by a factor of $1/\sqrt{(\in_R)}$, or approximately 30% shorter with a PTFE dielectric. However, since the length of the ¾-wave transformer is three times longer than that of the ¼-wave transformer, the ¾-wave transformer extends beyond the boundaries of the ¼-wave choke sleeve, enabling the ¾-wave transformer to be implemented with a continuous section of coaxial cable having constant diameter and constant characteristic impedance.

Figure 7:
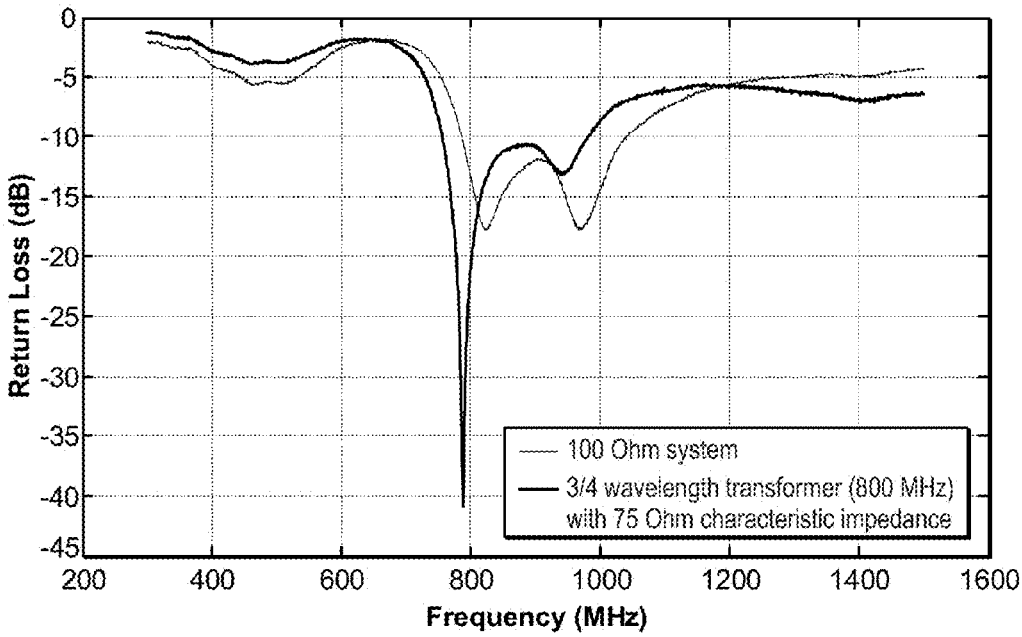
FIG. 7 is a graph comparing the Return Loss (dB) of an end-fed sleeve dipole comprising a ¾-wave transformer implemented with 75 Ohm coaxial line against that of a 100 Ohm system.

FIG. 7 is a graph comparing the Return Loss (dB) of an end-fed sleeve dipole comprising a ¾-wave transformer (green line) to that of an antenna with a 100 Ohm system impedance (blue line). The data shown in FIG. 7 was derived using a section of 75 Ohm coaxial line having a ¾-wave frequency of 800 MHz and a physical length of 182.5 mm. The graph indicates that a 50 Ohm system comprising a ¾-wave transformer implemented with 75 Ohm coaxial line is adequately well-matched to a 100 Ohm system. However, further comparison shows that the 100 Ohm system achieves slightly broader bandwidth than the transformed 50 Ohm system.

Although broader bandwidth may be obtained in the 100 Ohm system, such a system is not very practical, therefore, it is generally more desirable to use the ¾-wave transformer shown in FIG. 6A for transforming the impedance of a 50 Ohm source to a value closer to 100 Ohms. Semi-rigid coaxial cable is readily available with 70, 75 and 95 Ohm characteristic impedance all having the same outer diameter. Therefore, variations of a ¾-wave transformer comprising such characteristic impedance were investigated to determine an optimum antenna design.

Figure 8:
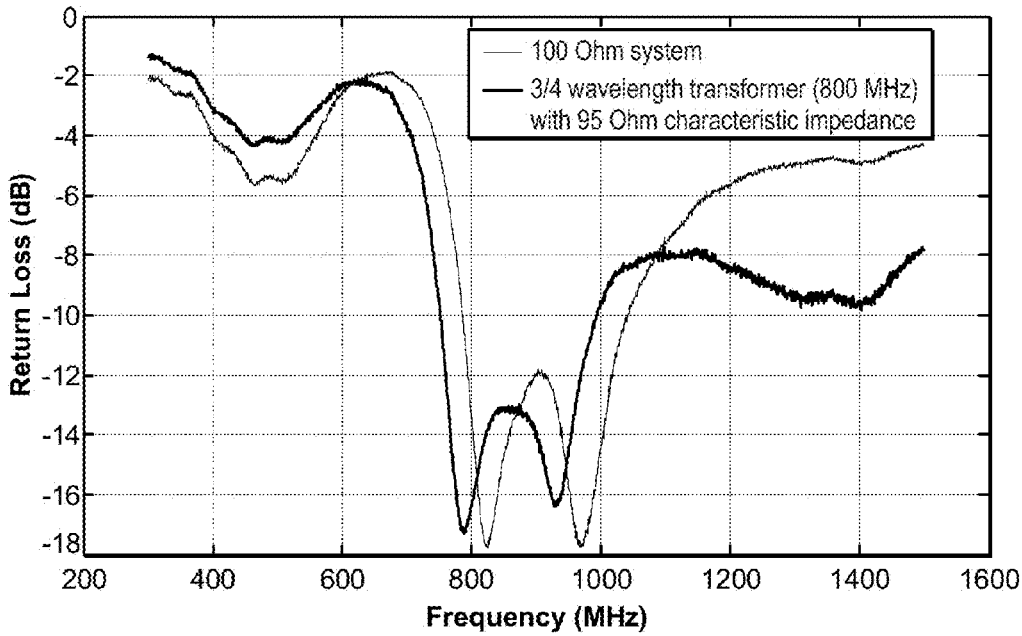
FIG. 8 is a graph comparing the Return Loss (dB) of an end-fed sleeve dipole comprising a ¾-wave transformer implemented with 95 Ohm coaxial line against that of a 100 Ohm system.

The Return Loss (dB) of an end-fed sleeve dipole comprising a ¾-wave transformer implemented with 95 Ohm coaxial line is compared against that of a 100 Ohm system in FIG. 8. The data shown in FIG. 8 was derived using a section of 95 Ohm coaxial line with a ¾-wave frequency of 800 MHz and a physical length of 182.5 mm. A commercially available semi-rigid coaxial cable suitable for this application is: UT-130-93-SP available from the Micro-Coax Company of 206 Jones Blvd. Pottstown, Pa. 19464. Like the 75 Ohm cable, the 95 Ohm cable also has a published propagation velocity of 70% of the free space speed of light. Thus, a section which is three-¼ wavelength long at 800 MHz has a physical length of 182.5 mm.

FIGS. 7-8 show that, while the 95 Ohm cable provides a better match to a 100 Ohm system, the loss is significantly higher at this impedance level. Moreover, the center conductor of the 95 Ohm cable is significantly smaller than that of the 75 Ohm cable, and thus, more difficult to work with. For these reasons, the present inventors concluded that a 75 Ohm coaxial cable is nearly optimum for implementing a ¾-wave transformer within an end-fed sleeve dipole operating in the range of 800-1000 MHz. One skilled in the art would understand how impedance transformers having alternative characteristic impedances may be suitable for other operating ranges.

The embodiment shown in FIG. 6A is very well matched to a theoretical 100 Ohm system and exhibits an acceptable radiation pattern in the vicinity of 800 MHz. To obtain good performance at other operating frequencies, one could simply scale the dimensions of the antenna design shown in FIG. 6A. For example, if operation in the vicinity of 936 MHz is desired, the dimensions of the original design could be scaled by 800/936=0.8547. In other words, a 1:0.8547 scale model of the antenna shown in FIG. 6A would function well at 936 MHz.

However, it is not convenient to scale all dimensions, as it is desirable to purchase, rather than fabricate, the semi-rigid coaxial cable and connector. Fortunately, since the end-fed sleeve dipole is a linear antenna, the performance depends primarily on the longitudinal or length dimensions of the antenna. Therefore, only the longitudinal dimensions should be scaled to achieve the desired operating frequency. While this may result in a scaled antenna design having greater diameter-to-length ratio, it is actually a beneficial change, since the radiation Q of such an antenna would become smaller, resulting in a larger impedance bandwidth.

In some embodiments, the antenna pattern can be improved further by employing a more effective choking scheme. FIG. 6B illustrates another preferred embodiment of the invention, in which second ¼-wave choke sleeve 690 followed by one or more ferrite choke beads 680 are added to improve the performance of end-fed sleeve dipole 600'. Second ¼-wave choke sleeve 690 increases the choking impedance, while ferrite beads 680 function to reduce coupling of the near electric field to the exterior of the coaxial feed transmission line.

Although three ferrite choke beads 680 are illustrated in FIG. 6B, the embodiment may employ one or more choke beads without departing from the scope of the invention. Common ferrite choke beads comprise a variety of different ferrite materials, such as Ni—Zn or Ni—Mg. In some embodiments, Ni—Zn ferrite beads may be preferred over Ni—Mg ferrite beads. This is because Ni—Zn ferrite beads have low relative permeability (less than 125) and low relative permittivity (10-12), and thus, provide better choking reactance than Ni—Mg beads.

The ¾-wave transformer shown in FIGS. 6A-B provides both impedance transformation and compensation for the end-fed sleeve dipole antenna. When coupled with an effective choking scheme (such as two ¼-wave choke sleeves), the resulting antenna demonstrates very good pattern characteristics. Although adequate for some applications, the input impedance match obtained with such a configuration is still not optimum. To produce an optimum design, a shunt resonator may be included in some embodiments of the invention to obtain additional impedance compensation, as described in more detail below.

Figure 9:
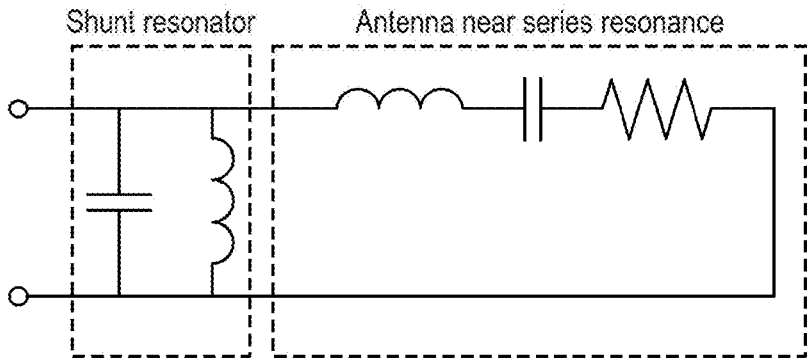
FIG. 9 is a circuit diagram illustrating a shunt LC resonator coupled in shunt with the input port of a linear antenna operating near its fundamental series resonance.

C. Embodiments of an End-Fed Dipole Including One or More ¼-Wave Choke Sleeves, ¾ Wave Transformer and a Shunt Resonator:

A typical ½-wave dipole, whether center-fed or end-fed, is operated near its fundamental series resonance. Below the fundamental series resonance, the input impedance is capacitive and above the fundamental series resonance (but below the first parallel or anti-resonance) it is inductive. Therefore, some amount of compensation can be achieved by connecting a shunt resonator in shunt with the input port of the antenna. An exemplary series-shunt compensation mechanism is shown schematically in FIG. 9. Although such a compensation mechanism has been used in center-fed dipoles (specifically, by incorporating the compensation mechanism within the balun), the compensation mechanism is surprisingly difficult to implement in the end-fed dipole, as the end-fed dipole does not include a balun at the feed region.

Figure 10:
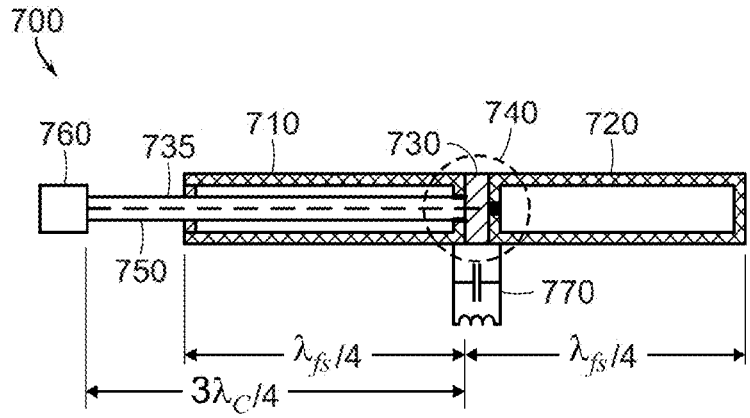
FIG. 10 is a cross-sectional diagram illustrating another preferred embodiment of an end-fed sleeve dipole comprising a single, ¼-wave choke sleeve, a ¾-wave transformer and a shunt resonator comprising lumped inductive (L) and capacitive (C) components.
Figure 11:
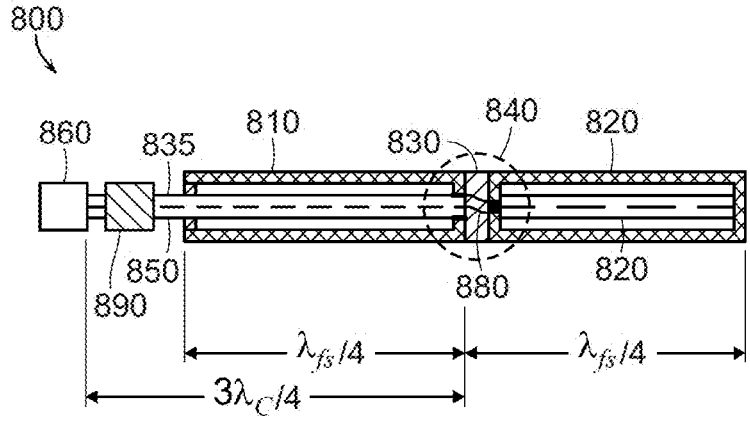
FIG. 11 is a cross-sectional diagram illustrating another preferred embodiment of an end-fed sleeve dipole comprising a single, ¼-wave choke sleeve, a ¾-wave transformer, a shunt resonator comprising a length of coaxial cable, a pair of transposition components for coupling the inner and outer conductors of the ¾-wave transformer and the shunt resonator, and a ferrite choke bead.

Two practical approaches for implementing a shunt resonator in an end-fed dipole are shown in FIGS. 10-11. Although illustrated in conjunction with a particular choking scheme (i.e., a single, ¼-wave choke), the shunt resonator described herein is compatible with other choking schemes, including but not limited to, any of the choking schemes described herein.

FIG. 10 illustrates another preferred embodiment of end-fed sleeve dipole 700 comprising a single ¼-wave choke sleeve and a ¾-wavelength transformer. Many of the components shown in FIG. 10 are described above in reference to FIG. 6A. Components with like numerals (e.g., 610-660 of FIGS. 6A and 710-760 of FIG. 10) will not be described further herein for purposes of brevity.

FIG. 10 generally differs from FIG. 6A by incorporating shunt resonator 770 across feed region 740 of the end-fed sleeve dipole. The shunt resonator is implemented in FIG. 10 by attaching (e.g., soldering) a lumped inductor (L) and capacitor (C) across the feed region. In one example, the shunt resonator could employ surface mount components in order to provide small size and high operating frequency (e.g., high SRF). However, the radiation Q of these elements is low and the mechanical attachment of the surface mount components diminishes the manufacturability, simplicity, and repeatability of the antenna design. That is, the antenna design shown in FIGS. 6A-6B is simple and elegant. This translates to an antenna that can be made precisely and with repeatable performance. In contrast, attaching surface mount LC components 770 across the feed region increases the complexity of the connections at the feed point, which may adversely affect precision and repeatability.

It is also noted that the symmetry of the sleeve dipole antenna should not be compromised with the addition of a shunt resonator. As noted above, end-fed sleeve dipoles are commonly used in Over-The-Air (OTA) testing, which requires an isotropic H-plane pattern. Unfortunately, any asymmetry in the antenna design may lead to an anisotropic H-plane pattern, which would be detrimental in OTA tests. In some embodiments, symmetry can be recovered by arranging some number (e.g., 2-4) of the shunt resonators shown in FIG. 10 around the feed region at regular angular intervals. In principle, the dipole antenna should be able to produce an isotropic H-plane pattern if a plurality of shunt resonators are symmetrically spaced around the feed region and the assembly of the sleeves is truly concentric about the dipole axis.

In some cases, it may still be difficult to produce a truly isotropic H-plane pattern with the antenna design shown in FIG. 10. For instance, if the mechanical junction between the surface mount components of the shunt resonator and the dipole elements is weak, the antenna may be easily bent and rendered asymmetric, even though the antenna is initially fabricated with perfect symmetry. The asymmetry may undesirably result in an anisotropic H-plane pattern. For this reason, a different approach for implementing a shunt resonator is shown in FIG. 11.

FIG. 11 illustrates yet another preferred embodiment of an end-fed sleeve dipole. In FIG. 11, end-fed sleeve dipole 800 is shown employing a ¼-wave choke sleeve and a ¾-wave transformer in the left half of dipole 810, and coaxial shunt resonator 870 in the right half of dipole 820. In some embodiments, one or more ferrite choke beads 890 may be coupled behind the ¼-wave choke sleeve to reduce near field coupling.

Coaxial shunt resonator 870 shown schematically in FIG. 11 is arranged within dipole element 820 that is normally empty and, thus, available for exploitation. In one embodiment, the coaxial shunt resonator may be implemented with a section of a coaxial cable having a length approximately equal to ¼ of a wavelength propagating through the coaxial cable, and a characteristic impedance chosen so as to balance a desired bandwidth with a desired impedance match. In one embodiment, a cable having a characteristic impedance of about 93-95 Ohms may be chosen for its compatibility with a ¾-wave transformer having a 70-75 Ohm characteristic impedance. However, it is possible to vary both the electrical length and the characteristic impedance of the coaxial shunt resonator to alter the balance between desired bandwidth and desired impedance match.

Figure 12:
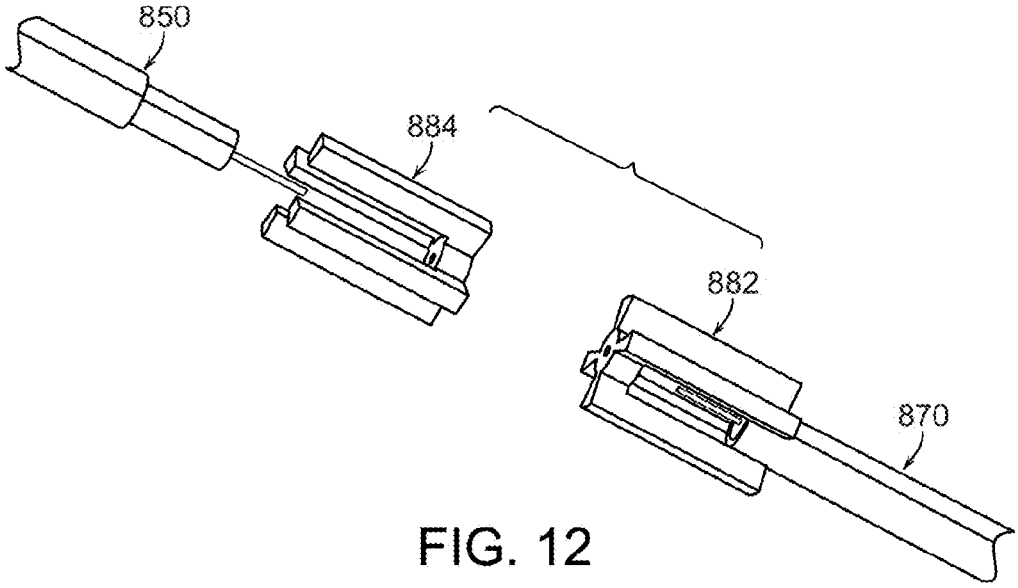
FIG. 12 is a 3-dimensional drawing of an exploded view of the inner-to-outer conductor transposition components shown schematically in FIG. 11.
Figure 13:
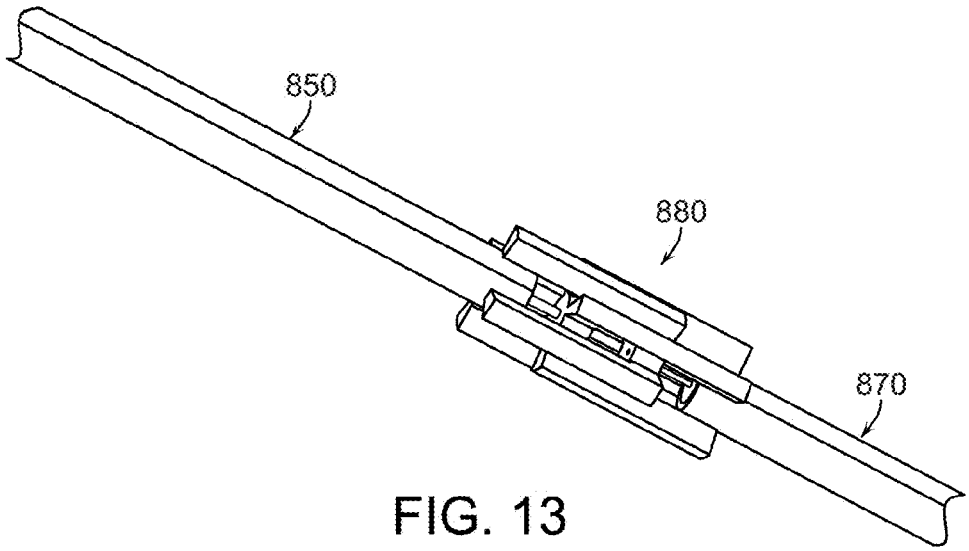
FIG. 13 is a 3-dimensional drawing illustrating how the transposition components may be used to electrically and mechanically couple the inner and outer conductors of the ¾-wave transformer and the coaxial shunt resonator.

A key electrical and mechanical component of the shunt-resonator compensated sleeve dipole is "transposition" 880 shown schematically in FIG. 11. An embodiment of a practical implementation of the transposition is shown in the 3-dimensional renderings of FIGS. 12-13. As shown in FIGS. 12-13, the transposition actually comprises two distinct, but symmetrically configured transposition components. One transposition component 882 couples the inner conductor of ¾-wave transformer 850 to the outer conductor of coaxial shunt resonator 870, while the other transposition component 884 couples the outer conductor of ¾-wave transformer 850 to the inner conductor of coaxial shunt resonator 870.

The exploded view of the inner-to-outer conductor transposition (880) shown in FIG. 12 depicts transposition 880 as comprising two distinct, but symmetrically configured transposition components 882/884. The assembled view shown in FIG. 13 illustrates how transposition 880 may be used to electrically and mechanically couple the inner and outer conductors of the ¾-wave transformer and the coaxial shunt resonator.

In one embodiment, the transposition components 882/884 may be fabricated through machining of a conductive material, such as copper. Although such machining contains fine details and must be precise, it is not beyond the capabilities of modern CNC machining, especially EDM. In one embodiment, the parts could be fabricated from Beryllium Copper both for ease of cutting and physical strength. Another possibility is SAE-65 C90700 Tin Bronze. This material machines very well and solders quite well.

It will be appreciated to those skilled in the art having the benefit of this disclosure that this invention is believed to provide an improved end-fed sleeve dipole. More specifically, the invention provides an end-fed sleeve dipole comprising one or more ¼-wave choke sleeves and a ¾-wave transformer. In some embodiments, one or more ferrite choke beads may be added to reduce near field coupling. In some embodiments, a shunt resonator may be added to provide additional impedance compensation. Further modifications and alternative embodiments of various aspects of the invention will be apparent to those skilled in the art in view of this description. It is intended, therefore, that the following claims be interpreted to embrace all such modifications and changes and, accordingly, the specification and drawings are to be regarded in an illustrative rather than a restrictive sense.

What is claimed is:

1. A sleeve dipole antenna, comprising:

a first hollow conductive tube forming a first dipole element of the sleeve dipole antenna;

a second hollow conductive tube forming a second dipole element of the sleeve dipole antenna, wherein the first and second hollow conductive tubes are coupled end-to-end and separated by a dielectric support;

a transmission feed line routed through the second hollow conductive tube along a longitudinal axis of the sleeve dipole antenna and coupled to one end of the first hollow conductive tube at a feed region of the sleeve dipole antenna, wherein the transmission feed line is operably configured as a ¾-wavelength transformer; and a single, coaxial shunt resonator coupled to the sleeve dipole antenna for impedance compensation, wherein the coaxial shunt resonator is formed from a length of coaxial cable, which extends along the longitudinal axis of the sleeve dipole antenna between opposite ends of the first hollow conductive tube.

2. The sleeve dipole antenna as recited in claim 1, wherein a characteristic impedance of the transmission feed line is greater than 50 ohms.

3. The sleeve dipole antenna as recited in claim 1, wherein a characteristic impedance of the transmission feed line ranges between about 70-100 ohms.

4. The sleeve dipole antenna as recited in claim 1, wherein an inner surface of the second hollow conductive tube and an outer surface of a first portion of the transmission feed line, which is routed through the second hollow conductive tube, forms a first choke sleeve for the sleeve dipole antenna, and wherein a physical length of the first choke sleeve is ¼ of a free-space wavelength long.

5. The sleeve dipole antenna as recited in claim 1, further comprising an input connector for coupling the transmission feed line to a source, wherein a length of the transmission feed line between the input connector and the feed region is ¾ wavelengths long at a center frequency of a wave propagating through the transmission feed line.

6. The sleeve dipole antenna as recited in claim 5, further comprising one or more choke beads coupled to the transmission feed line between the input connector and the second hollow conductive tube.

7. The sleeve dipole antenna as recited in claim 1, wherein a characteristic impedance of the coaxial shunt resonator ranges between about 90-95 Ohms.

8. The sleeve dipole antenna as recited in claim 1, further comprising a pair of transposition components coupled at the feed region for electrically connecting the transmission feed line to the coaxial shunt resonator.

9. The sleeve dipole antenna as recited in claim 8, wherein a first transposition component of the pair couples an inner conductor of the transmission feed line to an outer conductor of the coaxial shunt resonator, and wherein a second transposition component of the pair couples an inner conductor of the coaxial shunt resonator to an outer conductor of the transmission feed line.

10. The sleeve dipole antenna as recited in claim 1, further comprising a third hollow conductive tube arranged between the input connector and the second hollow conductive tube, wherein the transmission feed line is routed through the third hollow conductive tube along the longitudinal axis of the sleeve dipole antenna.

11. The sleeve dipole antenna as recited in claim 10, wherein an inner surface of the third hollow conductive tube and an outer surface of a second portion of the transmission feed line, which is routed through the third hollow conductive tube, forms a second choke sleeve for the sleeve dipole antenna, and wherein a physical length of the second choke sleeve is ¼ of a free-space wavelength long.

12. The sleeve dipole antenna as recited in claim 10, further comprising one or more choke beads coupled to the transmission feed line between the input connector and the third hollow conductive tube.

13. An end-fed sleeve dipole antenna, comprising:

a first dipole element and a second dipole element arranged back-to-back along a longitudinal axis of the dipole antenna, wherein the first and second dipole elements comprise hollow conductive tubes, which are separated by dielectric support at a feed region of the dipole antenna;

a first coaxial cable routed through the first dipole element along the longitudinal axis;

a second coaxial cable routed through the second dipole element along the longitudinal axis; and a pair of transposition components coupled to the first and second coaxial cables at the feed region of the dipole antenna for electrically connecting an inner conductor of the first coaxial cable to an outer conductor of the second coaxial cable and an inner conductor of the second coaxial cable to an outer conductor of the first coaxial cable.

14. The end-fed sleeve dipole antenna as recited in claim 13, wherein the first coaxial cable has a characteristic impedance of greater than 50 Ohms and a length approximately equal to ¾ of a wavelength of a wave propagating through the first coaxial cable.

15. The end-fed sleeve dipole antenna as recited in claim 13, wherein the second coaxial cable has a characteristic impedance of greater than 90 Ohms and a length approximately equal to ¼ of a wavelength propagating through the second coaxial cable.

16. The end-fed sleeve dipole antenna as recited in claim 13, wherein the pair of transposition components are symmetrically configured.

17. A sleeve dipole antenna, comprising:

a first hollow conductive tube forming a first dipole element of the sleeve dipole antenna;

a second hollow conductive tube forming a second dipole element of the sleeve dipole antenna, wherein the first and second hollow conductive tubes are coupled end-to-end and separated by a dielectric support;

a transmission feed line routed through the second hollow conductive tube along a longitudinal axis of the sleeve dipole antenna and coupled to one end of the first hollow conductive tube at a feed region of the sleeve dipole antenna, wherein a length of the transmission feed line is ¾ wavelengths long at a center frequency of a wave propagating through the transmission feed line; and one or more shunt resonators coupled to the sleeve dipole antenna for impedance compensation, wherein the one or more shunt resonators are formed of lumped inductive (L) and capacitive (C) elements, which are coupled in shunt across the feed region of the sleeve dipole antenna.

18. The sleeve dipole antenna as recited in claim 17, wherein a characteristic impedance of the transmission feed line ranges between about 70-100 ohms.

19. The sleeve dipole antenna as recited in claim 17, wherein an inner surface of the second hollow conductive tube and an outer surface of a first portion of the transmission feed line, which is routed through the second hollow conductive tube, forms a first choke sleeve for the sleeve dipole antenna, and wherein a physical length of the first choke sleeve is ¼ of a free-space wavelength long.

20. The sleeve dipole antenna as recited in claim 17, wherein the one or more shunt resonators comprise a plurality of shunt resonators symmetrically spaced around the feed region at regular angular intervals.

* * * * *